US008235796B2

(12) United States Patent
Nakamura

(10) Patent No.: US 8,235,796 B2
(45) Date of Patent: Aug. 7, 2012

(54) GAMING APPARATUS AND METHOD OF OPERATING THE SAME

(75) Inventor: Daisuke Nakamura, Kanagawa (JP)

(73) Assignee: Konami Gaming, Incorporated, Las Vegas, NV (US)

( * ) Notice: Subject to any disclaimer, the term of this patent is extended or adjusted under 35 U.S.C. 154(b) by 888 days.

(21) Appl. No.: 12/291,135

(22) Filed: Nov. 6, 2008

(65) Prior Publication Data

US 2010/0113129 A1 May 6, 2010

(51) Int. Cl.
*A63F 5/04* (2006.01)

(52) U.S. Cl. ..... 463/20; 273/143 R

(58) Field of Classification Search ..... 463/16–20, 463/25

See application file for complete search history.

(56) References Cited

U.S. PATENT DOCUMENTS 5,725,428 A 3/1998 Achmüller
2004/0198485 A1 * 10/2004 Loose et al. ..... 463/20
2007/0298864 A1 12/2007 Kosaka
2008/0045324 A1 2/2008 Kato
2008/0096655 A1 * 4/2008 Rasmussen et al. ..... 463/31
2008/0139274 A1 6/2008 Baerlocher
2008/0293476 A1 * 11/2008 Luciano et al. ..... 463/20
2009/0286589 A1 * 11/2009 Rasmussen ..... 463/20
2010/0240436 A1 * 9/2010 Wilson et al. ..... 463/20
2010/0248809 A1 * 9/2010 Fitzsimons et al. ..... 463/20

* cited by examiner

*Primary Examiner* — Masud Ahmed
(74) *Attorney, Agent, or Firm* — Muirhead and Saturnelli, LLC

(57) ABSTRACT

A gaming apparatus and a method of operating the same are disclosed. The gaming apparatus comprises a display configured to display a plurality of reel images and a processor operatively coupled to the display. The processor is operable to determine an arrangement of symbols for each of the reel images before starting each of games, by selecting symbols to be set on symbol stop positions of the reel image from discrete symbol candidates based on selection probabilities associated with the discrete symbol candidates respectively. The processor is also operable to control the display to display the reel images based on the determined arrangement of symbols in response to operation of a player.

20 Claims, 19 Drawing Sheets

SYMBOL SELECTION TABLE

| SYMBOL ID | SYMBOL CANDIDATE | SELECTION PROBABILITY | RANGE OF RANDOM NUMBER VALUE | | |
|---|---|---|---|---|---|
| 0 | W | 1/10 | 0 | ~ | 6553 |
| 1 | A | 1/10 | 6554 | ~ | 13107 |
| 2 | K | 2/10 | 13108 | ~ | 26214 |
| 3 | Q | 1/10 | 26215 | ~ | 32768 |
| 4 | J | 2/10 | 32769 | ~ | 45875 |
| 5 | 10 | 1/10 | 45876 | ~ | 52429 |
| 6 | 9 | 2/10 | 52430 | ~ | 65535 |

SYMBOL SELECTION TABLE

| SYMBOL ID | SYMBOL CANDIDATE | SELECTION PROBABILITY | RANGE OF RANDOM NUMBER VALUE | | |
|---|---|---|---|---|---|
| 0 | W | 1/10 | 0 | ~ | 6553 |
| 1 | A | 1/10 | 6554 | ~ | 13107 |
| 2 | K | 2/10 | 13108 | ~ | 26214 |
| 3 | Q | 1/10 | 26215 | ~ | 32768 |
| 4 | J | 2/10 | 32769 | ~ | 45875 |
| 5 | 10 | 1/10 | 45876 | ~ | 52429 |
| 6 | 9 | 2/10 | 52430 | ~ | 65535 |

*FIG. 8*

SYMBOL ARRANGEMENT TABLE

| | | REEL NUMBER | | | | |
|---|---|---|---|---|---|---|
| | | 1 | 2 | 3 | 4 | 5 |
| SYMBOL STOP POSITION NUMBER (PN) | 1 | 1 | 2 | 2 | 1 | 6 |
| | 2 | 4 | 6 | 6 | 6 | 2 |
| | 3 | 5 | 3 | 6 | 5 | 3 |
| | 4 | 2 | 4 | 2 | 3 | 0 |
| | 5 | 0 | 0 | 4 | 4 | 6 |
| | 6 | 6 | 2 | 1 | 0 | 5 |
| | 7 | 4 | 6 | 3 | 6 | 4 |
| | 8 | 3 | 1 | 0 | 2 | 2 |
| | 9 | 2 | 4 | 4 | 2 | 4 |
| | 10 | 6 | 5 | 5 | 4 | 1 |

*FIG. 9*

MODIFIED SYMBOL SELECTION TABLE

| SYMBOL ID | SYMBOL CANDIDATE | SELECTION PROBABILITY | RANGE OF RANDOM NUMBER VALUE | | |
|---|---|---|---|---|---|
| 0 | W | 1/9 | 0 | ~ | 7281 |
| 1 | A | 0 | — | ~ | — |
| 2 | K | 2/9 | 7282 | ~ | 21844 |
| 3 | Q | 1/9 | 21845 | ~ | 29126 |
| 4 | J | 2/9 | 29127 | ~ | 43689 |
| 5 | 10 | 1/9 | 43690 | ~ | 50971 |
| 6 | 9 | 2/9 | 50972 | ~ | 65535 |

*FIG. 14*

MODIFIED SYMBOL SELECTION TABLE

| SYMBOL ID | SYMBOL CANDIDATE | SELECTION PROBABILITY | RANGE OF RANDOM NUMBER VALUE | | |
|---|---|---|---|---|---|
| 0 | W | 1/8 | 0 | ~ | 8191 |
| 1 | A | 0 | — | ~ | — |
| 2 | K | 2/8 | 8192 | ~ | 24575 |
| 3 | Q | 1/8 | 24576 | ~ | 32767 |
| 4 | J | 1/8 | 32768 | ~ | 40959 |
| 5 | 10 | 1/8 | 40960 | ~ | 49151 |
| 6 | 9 | 2/8 | 49152 | ~ | 65535 |

*FIG. 15*

MODIFIED SYMBOL SELECTION TABLE

| SYMBOL ID | SYMBOL CANDIDATE | SELECTION PROBABILITY | RANGE OF RANDOM NUMBER VALUE | | |
|---|---|---|---|---|---|
| 0 | W | 1/7 | 0 | ~ | 9361 |
| 1 | A | 0 | — | ~ | — |
| 2 | K | 2/7 | 9362 | ~ | 28085 |
| 3 | Q | 1/7 | 28086 | ~ | 37447 |
| 4 | J | 1/7 | 37448 | ~ | 46810 |
| 5 | 10 | 0 | — | ~ | — |
| 6 | 9 | 2/7 | 46811 | ~ | 65535 |

*FIG. 16*

GAMING APPARATUS AND METHOD OF OPERATING THE SAME

FIELD OF THE INVENTION

The present invention relates generally to a gaming apparatus which displays a plurality of reel images, and more particularly to a slot machine installed in a casino or the like.

BACKGROUND OF THE INVENTION

In a traditional mechanical slot machine, a player inserts a coin or token and pulls down on the slot machine handle to initiate the game. Three parallel rotatable reels with an assortment of fruit, number and/or bar symbols are then caused to spin until each reel reaches a resting position. The success or failure of the game is then determined by comparing the combination of reel symbols across a horizontal row with a table of winning combinations posted on the slot machine. To add interest to the game, the basic mechanical slot machine windows are frequently made large enough to show three adjacent symbols on each reel and thereby allow betting involving multiple rows. This betting can take the form, for example, of betting on the combinations formed across the upper horizontal row, middle horizontal row and lower horizontal row. Betting along diagonal lines intersecting these rows is also made possible.

With recent development of electronic technology, there have been many improvements to the basic slot machine. One of these improvements is an electronic slot machine that uses a video display to imitate three parallel rotatable reels, rather than having three actual reels themselves. In operation, the electronic slot machine simulates the rotation of a physical reel on the display, and typically selects the final symbols through use of random numbers generated by a microprocessor. However, in the conventional electronic slot machine, the combination and arrangement of symbols on each reel image are predetermined and fixed. Therefore, it is possible for a player to memorize the arrangement of all or a part of symbols by repeating the game plays with the same slot machine and the monotonous display of symbols of each reel image causes a degradation of entertainment for the slot game.

Another type of a gaming apparatus without mechanical reels is shown in U.S. Patent Publication No. US2007/0298864. In this gaming apparatus, a plurality of symbol display areas is defined as discrete fixed display areas on symbol display portion. When a game is started in response to a bet being operated, symbols to be displayed on the symbol display areas are selected among a plurality of different kinds of symbols. The selected symbols are displayed on the corresponding symbol display areas at once, in random order or in a predetermined order. The symbols are statically displayed on the symbol display without dynamical motion (e.g. spinning) of symbols on the symbol display portion. Therefore, in the gaming apparatus without displaying any reel images in U.S. Patent Publication No. US2007/0298864, slot game entertainment for players is degraded by a lack of rotating symbols on the symbol display portion, and the players have an impression that the game is fully controlled by the gaming apparatus side because any player's operation for stopping each reel rotation is not needed.

BRIEF SUMMARY OF THE INVENTION

In one aspect of the present invention, a gaming apparatus comprises a display configured to display a plurality of reel images and a processor operatively coupled to the display.

The processor is operable to determine an arrangement of symbols for each of the reel images before starting each of games, by selecting symbols to be set on symbol stop positions of the reel image from discrete symbol candidates based on selection probabilities associated with the discrete symbol candidates respectively. The processor is also operable to control the display to display the reel images based on the determined arrangement of symbols in response to operation of a player.

In another aspect of the present invention, a method of operating a gaming apparatus with a display comprises determining an arrangement of symbols for each of reel images before starting each of games and displaying the reel images on the display based on the determined arrangement of symbols in response to operation of a player. The arrangement of symbols for each of reel images is determined by selecting symbols to be set on symbol stop positions of the reel image from discrete symbol candidates based on selection probabilities associated with the discrete symbol candidates respectively.

BRIEF DESCRIPTION OF THE DRAWINGS

FIG. 8 shows a symbol selection table;

FIG. 9 shows a symbol arrangement table;

FIG. 14 shows the modified symbol selection table after selecting a symbol at the first symbol stop position;

FIG. 15 shows the modified symbol selection table after selecting a symbol at the second symbol stop position;

FIG. 16 shows the modified symbol selection table after selecting a symbol at the third symbol stop position;

DETAILED DESCRIPTION

Illustrative embodiments and aspects of the present disclosure are described below. In the interest of clarity, not all features of an actual implementation are described in the specification. It will of course be appreciated that in the development of any such actual embodiment, numerous implementation-specific decisions must be made to achieve the developers' specific goals, such as compliance with system-related and business-related constraints, that will vary from one implementation to another. Moreover, it will be appreciated that such development effort might be complex and time-consuming, but would nevertheless be a routine undertaking for those of ordinary skill in the art having benefit of the disclosure herein.

Figure 1:
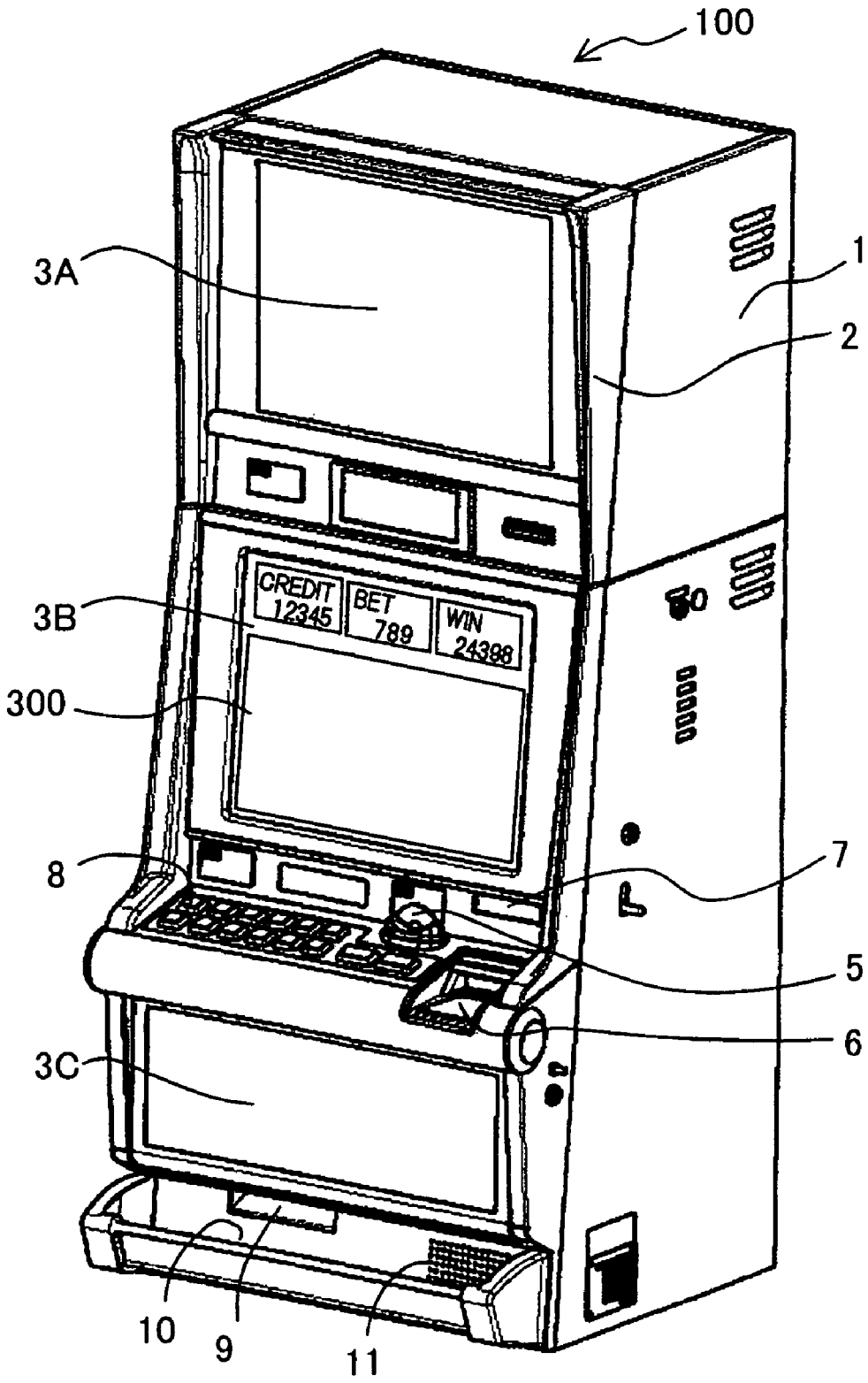
FIG. 1 is a perspective view of a gaming apparatus according to an embodiment of the present invention.

FIG. 1 shows a perspective view of a gaming apparatus according to an embodiment of the present invention. As shown in FIG. 1, the gaming apparatus 100 comprises a box-shape cabinet 1 as a housing with a front panel 2. Three display windows 3A, 3B, and 3C are provided on the upper portion, the middle portion, and the lower portion of the front panel 2, and configured with a planate screen display or a curved screen display, respectively. A coin inlet 5, a bill/ticket inlet 6, a ticket outlet 7, and various operation buttons 8 are provided on the front panel 2 between the middle display window 3B and the lower display window 3C. A coin outlet 9, a coin receiver 10, and a speaker 11 are installed on the front panel 2 below the lower display window 3C.

The three display windows 3A, 3B, and 3C reproduce various images, for example, images for use in decoration such as the logo of a game developer, images for use in advertisements, images for use in visual effects in games, and visualized information on games such as pay tables, illustrations of game content, and jackpot values In particular, the middle display window 3B displays five (or more) image display columns for reel images, the number of available credits of a player, the amount of a bet, and the amount of an award that the player wins.

When the player enters coins and bills into the coin inlet 5 and the bill/ticket inlet 6, respectively, the validity and counted of the coins and bills will be checked by coin/bill counters installed inside the cabinet 1. The total count of the inserted coins and bills are displayed on the middle windows 3B as player credits. The player may also enter a ticket into the bill/ticket inlet 6. On the surface of the ticket, the amount of the player's credits is printed with numbers and bar code. The amount of the credits is decoded by a ticket reader installed in the bill/ticket inlet 6 from the bar code printed on the ticket, and then the amount of the credits is displayed on the middle display window 3B.

The player operates the gaming apparatus 100 by using the buttons 8. For example, the player can select one or more winning lines of the symbol matrix displayed on the middle display window 3B by using one or more buttons 8. The selected winning lines will be shown in the middle display window 3B. The player then enters a bet into the gaming apparatus 100 by using one or more buttons 8. The bet is placed on each of the selected winning lines. The amount of the bet will be displayed on the middle display window 3B. The player will then push a start button (one of the buttons 8), and the symbols will start moving in the vertical direction in the middle display window 3B. After that, the player will push one or more stop buttons (included in the buttons 8), and then the symbols will stop column by column. When a winning combination appears on one of the selected winning lines in the stopped symbol matrix, the player will win an award depending on the bet and the probability of the winning combination. The player will then push a payout button (one of the buttons 8), and thereby coins equivalent to the player's credit will be discharged out of the coin outlet 9 from a coin hopper installed in the cabinet 1 and stored in the coin receiver 10. Alternatively, a ticket will come out of the ticket outlet 7. On the ticket, the amount of the player's credits will be printed in numbers and a bar code by a ticket printer installed in the ticket outlet 7. At the time of the payout, the player can also use the buttons 8 to select either coins or a ticket.

Figure 2:
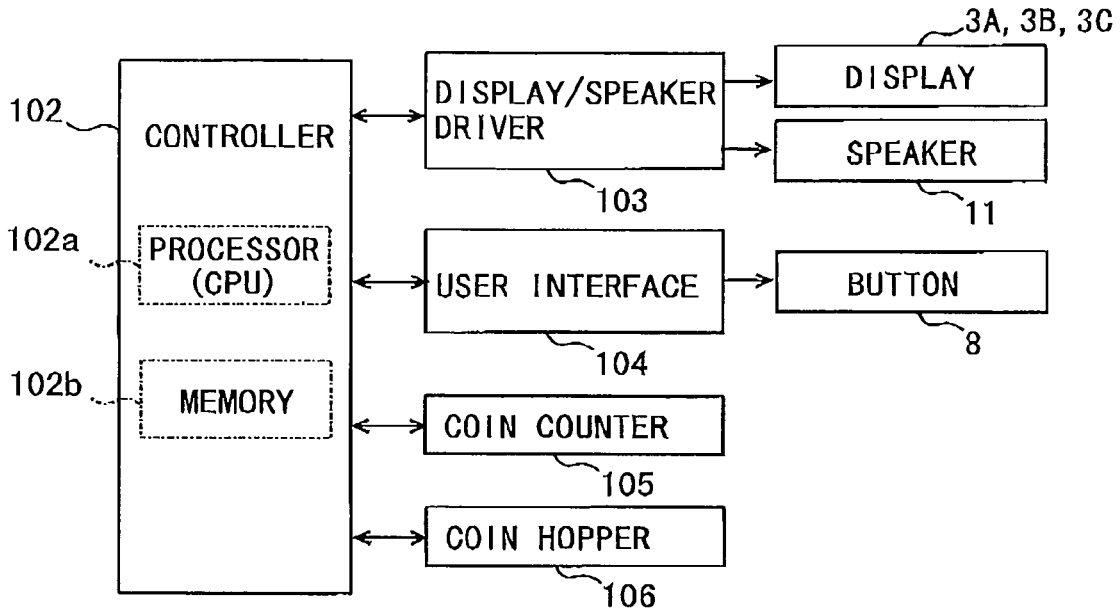
FIG. 2 is a block diagram showing a configuration of a control system of the gaming apparatus 100.

FIG. 2 is a block diagram that shows a configuration of a control system 101 of the gaming apparatus 100 shown in FIG. 1. The control system 101 provides gaming functions and visual/sound effects by using control over devices installed in the cabinet 1. As shown in FIG. 2, the control system 101 includes a controller 102, display/speaker drivers 103, a user interface 104, a coin counter 105 and a coin hopper 106. The controller 102 includes a processor (CPU) 102*a* and a memory 102*b*. The processor 102*a* is coupled with the memoir 102*b*, the display/speaker drivers 103, the user interface 104, the coin counter 105 and the coin hopper 106. The controller 102 runs various programs stored in the memory 102*b* and thereby controls other components of the control system 101. In particular, the controller 102 determines an arrangement of symbols for each of the five reel images before starting each of slot games. Furthermore, the controller 102 generates at least one random number in a lottery process and uses them in each game. Depending on the random number, for example, a wining combination of symbols can appear in the stopped symbol matrix displayed on the middle display window 3B. In addition, by using the display/speaker drivers 103, the controller 102 will control images displayed on the three display windows 3A, 3B, and 3C, and sounds that come out of the speaker 11 (cf. FIG. 1). The user interface 104 relays various instructions from the buttons 8 to the controller 102. The controller 102 manages the amount of the player's credits, which is equivalent to the amount of money inserted into the coin inlet 5 and the bill/ticket inlet 6. The controller 102 also performs payout of the player's credits in coins discharged from the coin hopper 106. The payout may be performed by using a ticket on which the amount of the credits is printed by the ticket printer.

Figure 3:
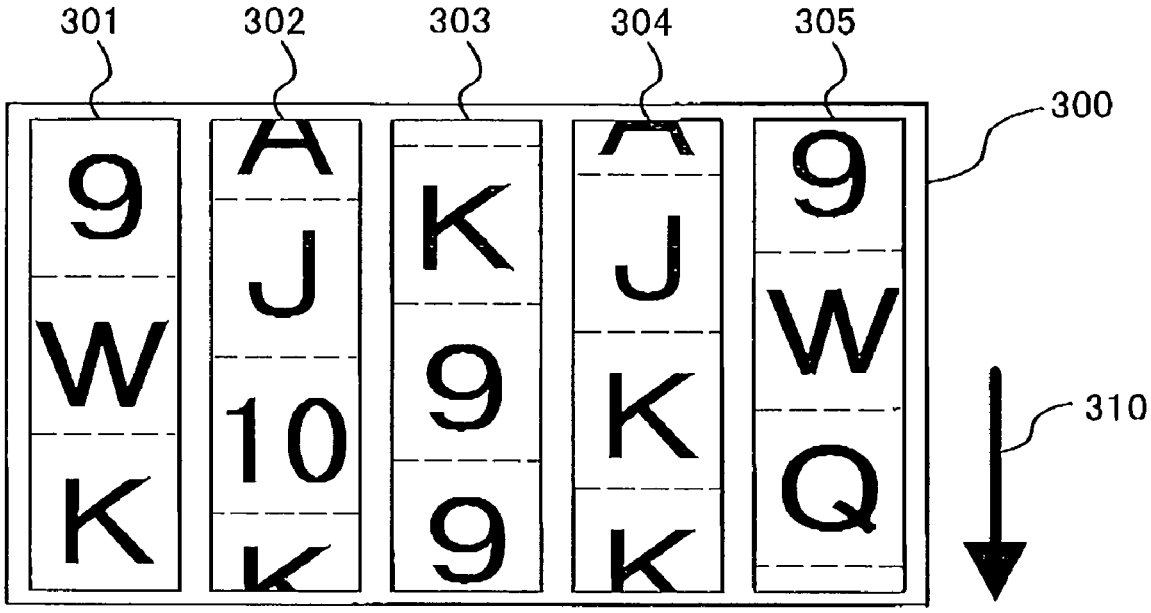
FIG. 3 is an explanatory view illustrating an example of a reel display portion when moving symbols of reel images.
Figure 4:
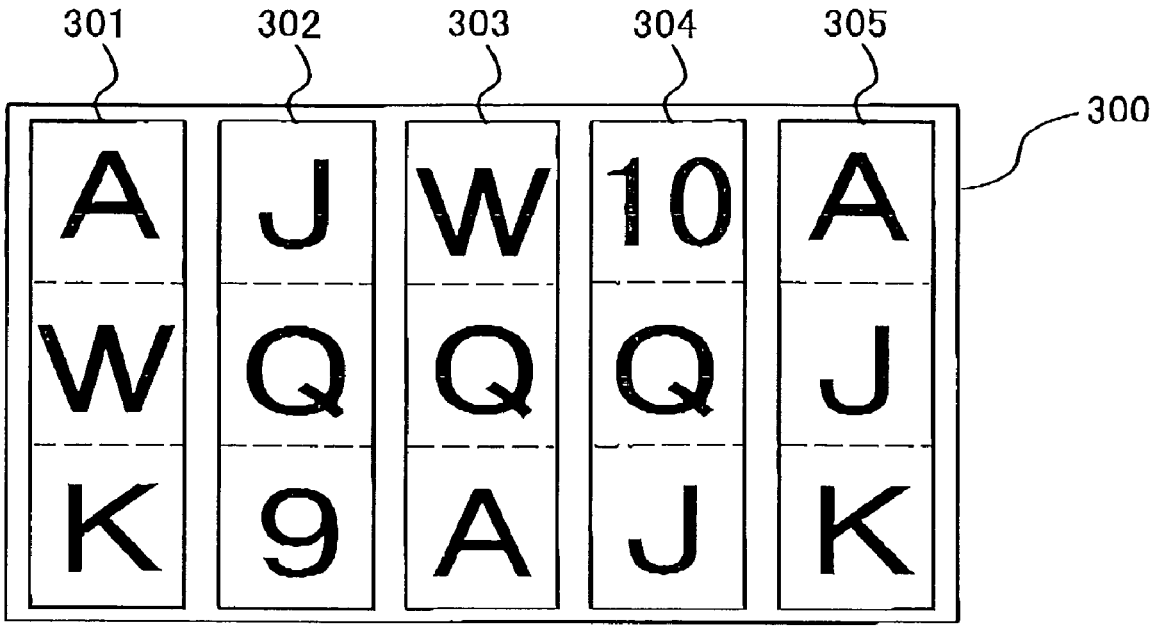
FIG. 4 is an explanatory view illustrating an example of a reel display portion after the moving of symbols is stopped.

FIGS. 3 and 4 are explanatory views illustrating an example of a reel display portion 300 on the middle display window 3B. The reel display portion 300 includes five column display areas 301-305 which are defined for displaying discrete reel images side by side respectively. Each of the reel images with a predetermined arrangement of symbols is displayed on the corresponding display area to imitate a rotatable reel so that each of the reel images is successively moved and then stopped on the display in response to operation of a player. The symbols of each reel image are displayed so as to move in the direction of an arrow 310 as shown in FIG. 3 after starting a unit game. The moving of symbols on each of the column display areas 301-305 is stopped as shown in FIG. 4 after a lapse of a predetermined time. In this example of reel display portion 300, three symbols are appeared on each column display area 301-305 after stopping the symbol motion.

In the example of game process described with FIGS, 2, 3 and 4, the arrangement of symbols for each of the reel images is determined in response to the BET operation which is an operation for starting each of games. The arrangement of symbols for each of the reel images used for a next game may be determined in response to a operation of terminating each of games.

Figure 5:
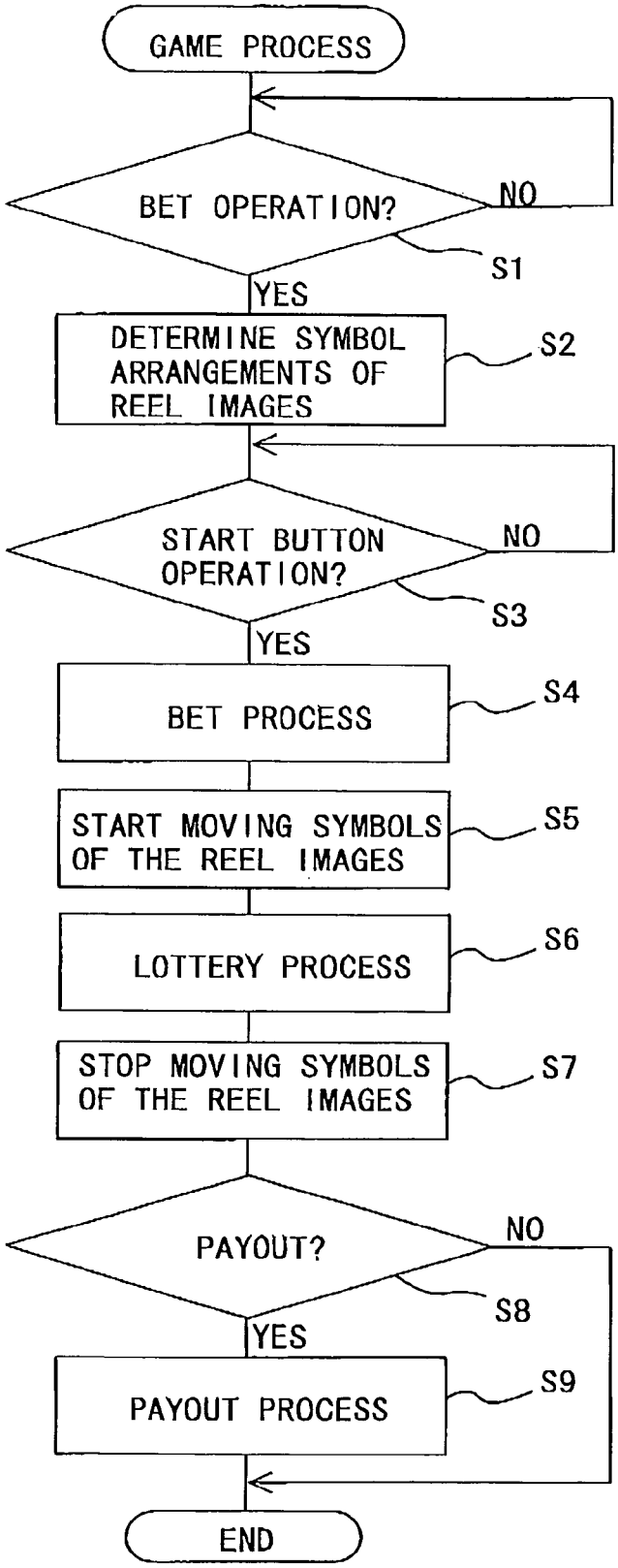
FIG. 5 is a flowchart showing an example of a main game process of the gaming apparatus.

FIG. 5 is a flowchart showing an example of a main game process of the gaming apparatus 100. Before starting a slot game, a player operates one the buttons 8 so as to select at least one winning line on the middle display window 3B and an amount of credits for the selected bet line (S1). After the BET operation, the controller 102 determines an arrangement of symbols for each of the five reel images (S2) The determination of symbol arrangements is conducted by selecting symbols to be set on symbol stop positions of the reel image from discrete symbol candidates based on selection probabilities associated with the discrete symbol candidates respectively.

When the player operates the start button (S3), the controller 102 executes a BET process in which the credits in the memory 102*b* are reduced by an amount of credit that corresponds to the operation performed by the player (S4). The amount of credit is derived from multiplying the number of bet lines selected by the amount of credits placed in a bet. For example, if three bet lines are selected and two credits are selected as the amount of credits placed in a bet, then the amount bet in one game is six credits.

After the BET process, the controller 102 controls the display driver 103 so as to start moving symbols of the five reel images as shown in FIG. 3 (S5) and performs a lottery process (S6). In this lottery process, the controller 102 generates a random number for each of the reel images displayed on the reel display portion. The controller 102 compares the random numbers with reel stop position tables stored in the memory 102*b*. The reel stop position table is prepared for each of the reel images. The reel stop position of each reel image is determined based on the corresponding random number and the reel stop position table. In other words, a symbol is selected from the symbols forming each reel image based on the corresponding random number and the reel stop position table. Each of the selected symbols will be finally displayed at the center of each of the column display areas 301-305. The controller 102 also determines whether or not a combination of the random numbers will win a predetermined prize by comparing the random numbers with a prize winning determination table stored in the memory 102*b*.

After the lottery process, the controller 102 controls the display driver 103 to stop moving symbols of the reel images on the reel display portion 300 so that each of the selected symbols determined by the lottery process is stopped at the center of each of the column display area 301-305 as shown in FIG. 4 (S7).

If it is determined that the dividend paying prize has been won in the foregoing lottery process, the controller 102 executes a payout process in which the amount of credit in accordance with the prize is added to the credit data stored in the memory 102*b* (S8, S9), and the game is finished.

Figure 6:
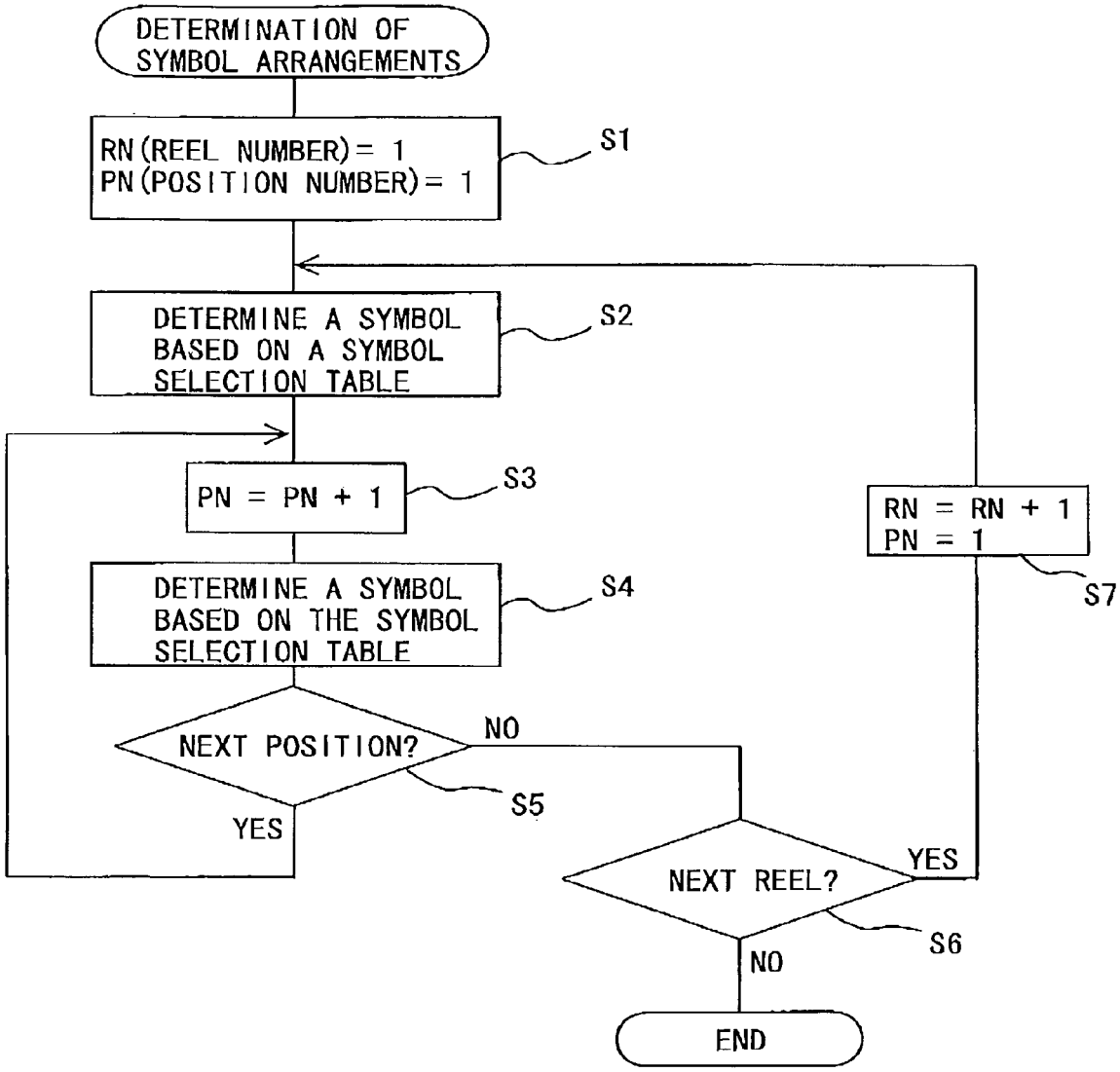
FIG. 6 is a flowchart showing the symbol determination process for symbol arrangements according to one embodiment of the present invention.
Figure 7:
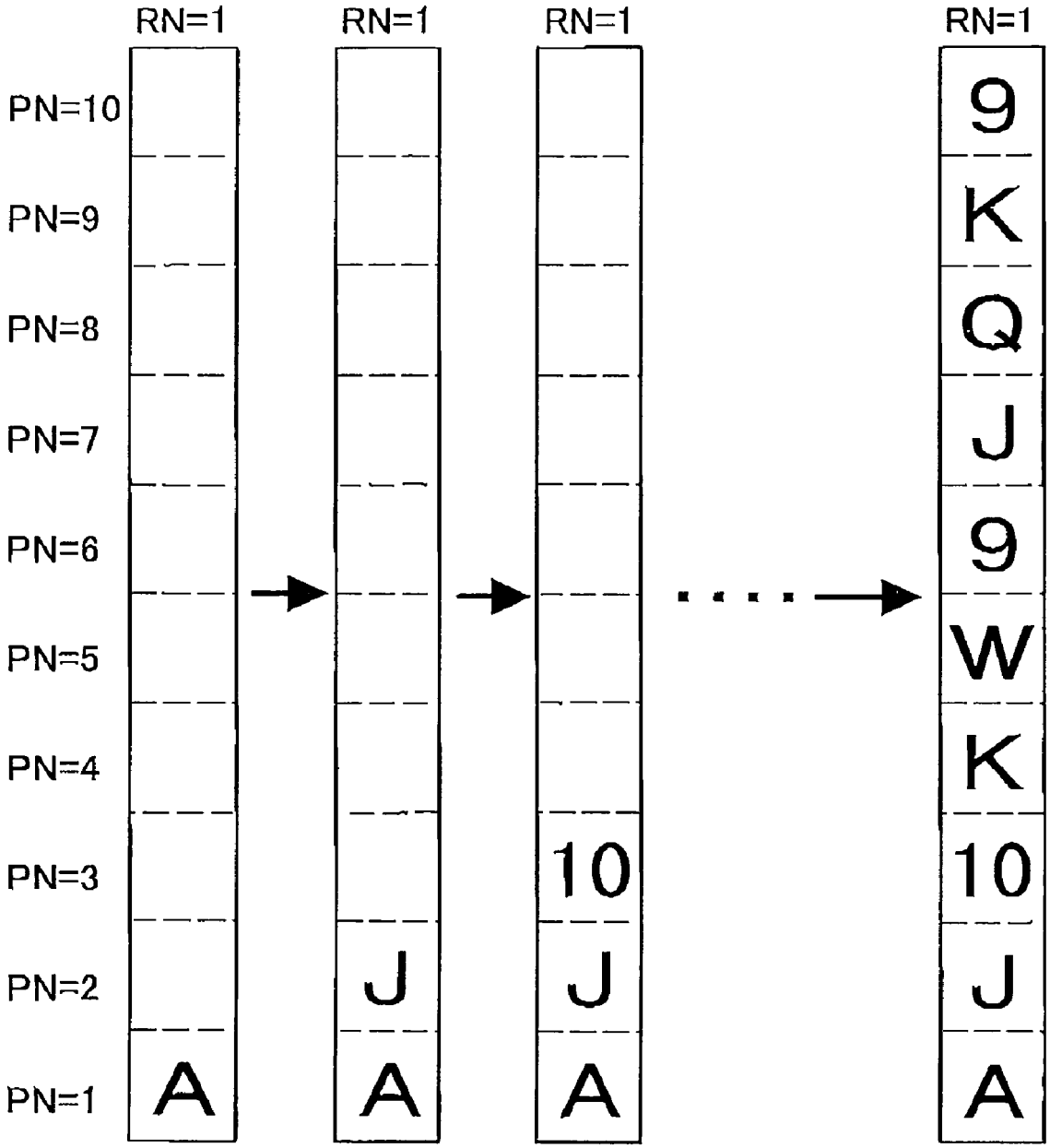
FIG. 7 is an explanatory view illustrating symbol selection steps of the symbol determination process.

FIG. 6 is a flowchart showing the symbol determination process for symbol arrangements according to one embodiment of the present invention. FIG. 7 is an explanatory view illustrating symbol selection steps of the symbol determination process. In this embodiment, it is assumed that five reel images are displayed on the reel display portion 300 and each of the reel images is configured to have ten symbol stop positions. Each of the reel images is identified with a parameter of RN (reel number) and each of the symbol stop positions is identified with another parameter of PN (position number). Symbol on each of the symbol stop positions is selected from a common set of the discrete symbol candidates in a manner to allow a redundant symbol selection from the discrete symbol candidates for each of the reel images. The symbol arrangements are determined by selecting symbols to be set on symbol stop positions of the reel image from discrete symbol candidates based on selection probabilities associated with the discrete symbol candidates respectively.

FIG. 8 shows an example of a symbol selection table in which the symbol candidates and the associated selection probabilities are listed together with ranges of random number values corresponding to the selection probabilities respectively. The number of discrete symbol candidates in FIG. 8 is set to be equal to or smaller than the number of the symbol stop positions. In this embodiment, the number of the discrete symbol candidates may be set to be larger than the number of the symbol stop positions of each of the reel images. The symbol selection table is stored in the memory 102*b* or one of other storage units such as a magnetic disc, an optical disk, a memory card, or the like. The gaming apparatus may be configured to include a communication unit to communicate with an external apparatus such as a computer apparatus, a server, a memory card, etc. and data of the symbol selection table may be received from the external apparatus via a communication network or a communication interface by the communication unit.

After the aforementioned 13ET operation in FIG. 6, the processor 102*a* of the controller 102 initializes values of the RN and PN (S1) for determining the symbol arrangement of the first reel image (RN=1). The processor 102*a* generates a random number in a predetermined range (e.g. 0 to 65535) and determines a symbol at the first symbol stop position (PN=1) of the first reel image (RN=1) based on the generated random number value and the symbol selection table stored in the memory 102*b* (S2). In this example, the random number value in the range between 6554 and 13107 is generated and the symbol of "A" is selected as a symbol at the first symbol stop position (PN=1) of the first reel image (RN=1). Thereafter, the processor 102*a* counts up the value of PN (S3) and generates a random number and determines a symbol at the second symbol stop position (PN=2) based on the common symbol selection table in FIG. 8 (S4). The symbol of "J" is selected as a symbol at the second symbol stop position in this example. The processor 102*a* repeats the procedures S3 and S4 for all of the remaining symbol stop positions (PN=3 to 10) (S5). The processor 102*a* also repeats the procedures S2 to S5 for determining all of the remaining reel images (RN=2 to 5) (S6, S7).

Figure 10:
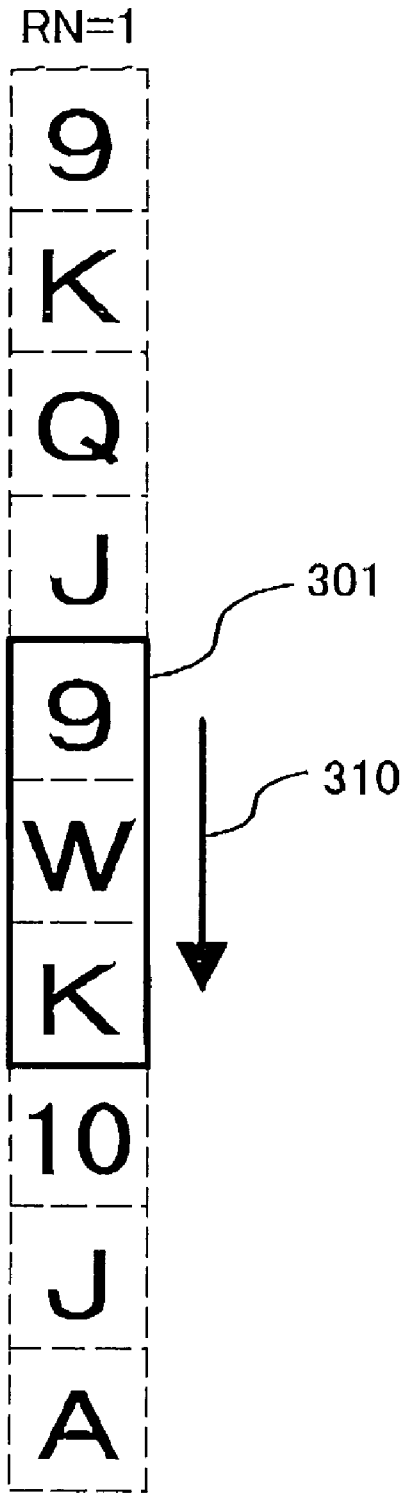
FIG. 10 is an explanatory view illustrating a display of the selected symbols.

FIG. 9 is an example of a symbol arrangement table showing a list of symbol ID numbers for each symbol stop position of each reel image, which is obtained by the symbol determination process. The controller 102 controls the display driver 103 based on the symbol arrangement table. At least three sequential symbols of the determined symbol arrangement are displayed so as to move in the direction of an arrow 310 on the column display area 301 when imitating a reel rotation as shown in FIG. 10. According to the symbol determination process in this embodiment, the symbol arrangements of the reel images can be changed with respect to each game.

Figure 11:
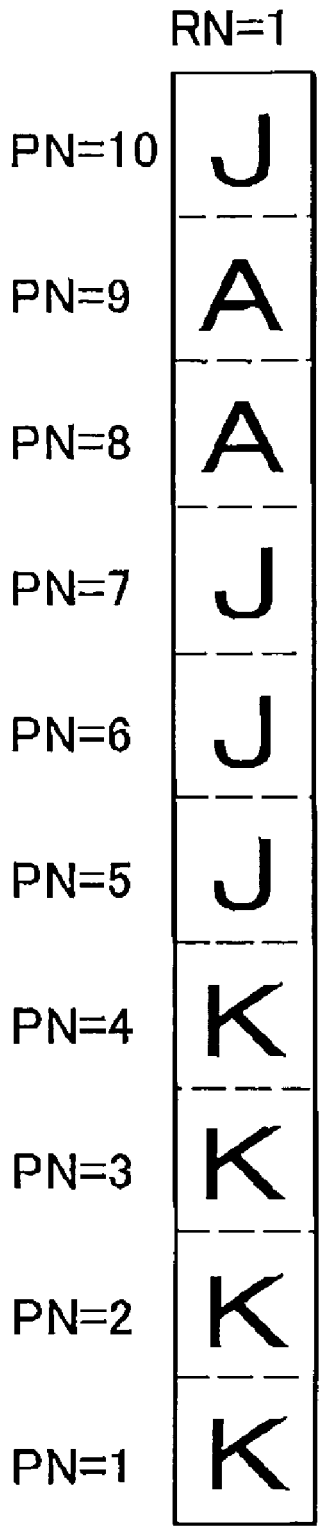
FIG. 11 shows another example of the selected symbol arrangement.
Figure 12:
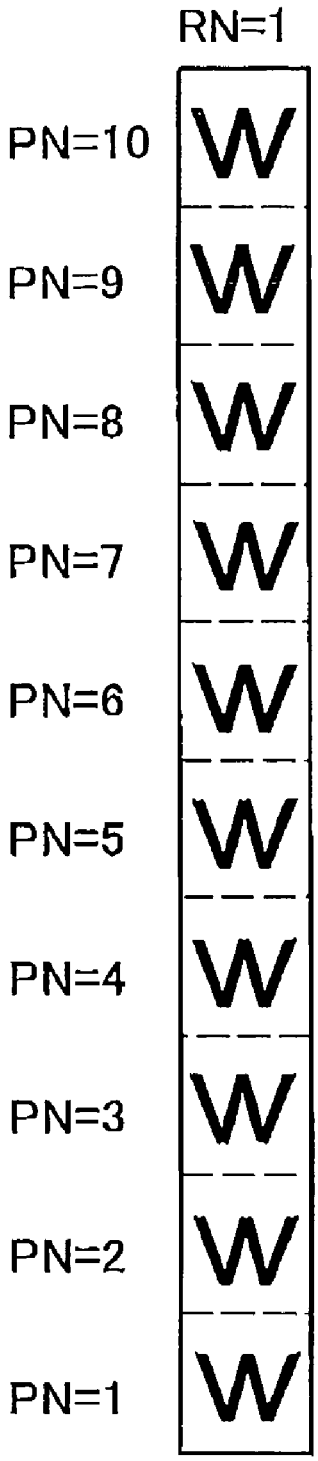
FIG. 12 shows yet another example of the selected symbol arrangement.

FIGS. 11 and 12 show other examples of the symbol arrangements by the symbol determination process based on the common symbol selection table in FIG. 8, respectively. These symbol arrangements include one or more sequential symbol sets of the same symbol such as symbols of "A", "J", "K" in FIG. 11 and a symbol of "W" in FIG. 12. The same symbols are located on the adjacent symbol stop positions of the reel image. Although the reel image including the sequential symbol set is determined in relatively low probability, it is possible to give a player a visual impact on the reel image with the sequential symbol set.

Figure 13:
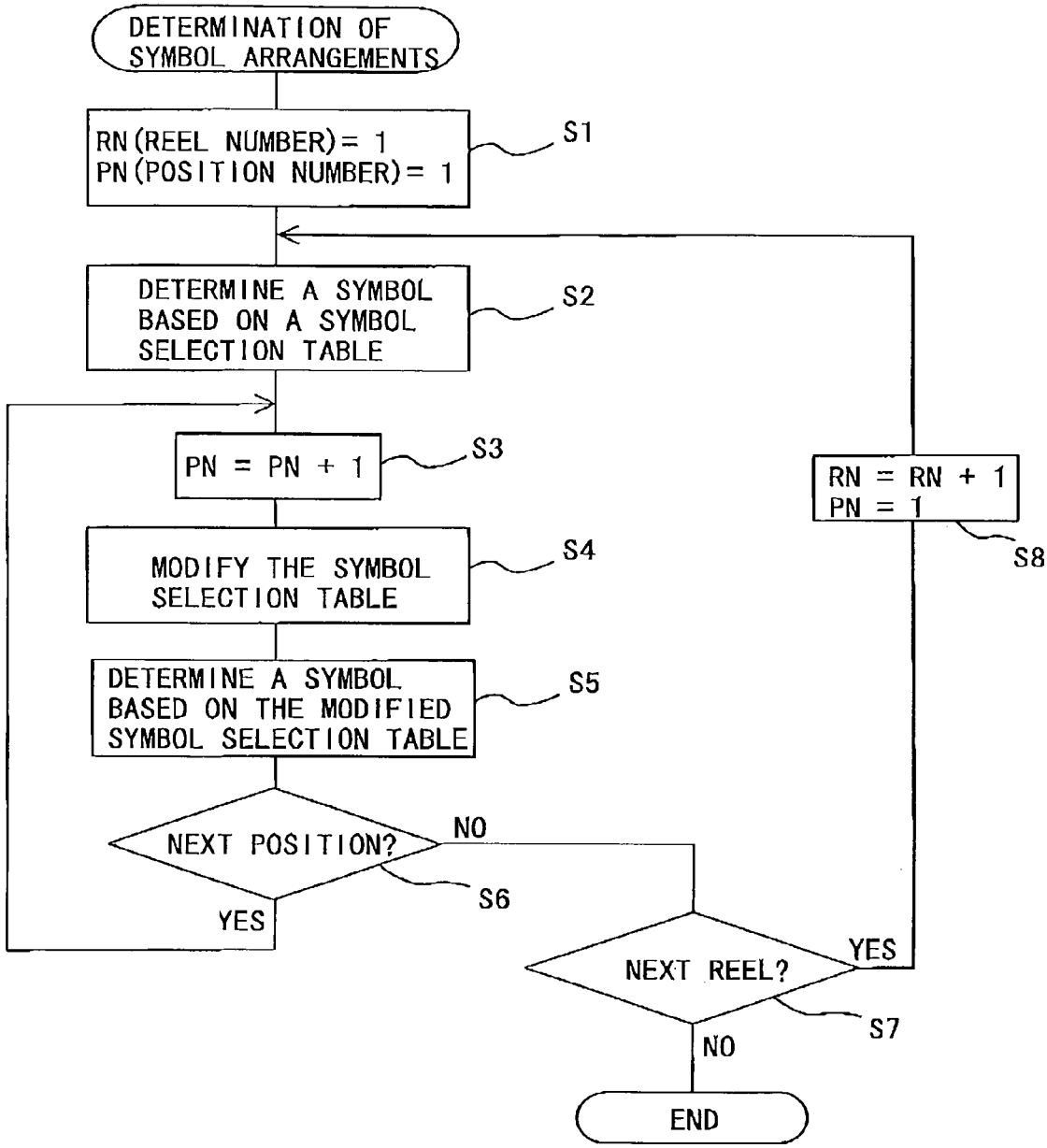
FIG. 13 is a flowchart showing the symbol determination process for symbol arrangements according to another embodiment of the present invention.

FIG. 13 is a flowchart showing the symbol determination process for symbol arrangements according to another embodiment of the present invention. In this embodiment, the number of discrete symbol candidates is set to be equal to or smaller than the number of the symbol stop positions. The symbol determination process is performed so that all kinds of the symbol candidates are necessarily included in each of the reel images for each game.

After the aforementioned BET operation in FIG. 13, the processor 102*a* of the controller 102 initializes values of the RN and PN (S1) and generates a random number in the predetermined range of 0 to 65535 and determines a symbol at the first symbol stop position (PN=1) of the first reel image (RN=1) based on the generated random number value and the symbol selection table shown in the foregoing FIG. 8 (S2). Thereafter, the processor 102*a* counts up the value of PN (S3) and modifies the symbol selection table (S4). In the symbol selection table, the selection probabilities associated with the discrete symbol candidates for each of the reel images is defined as a fractional expression with a common denominator and a discrete numerator. The common denominator is equal to or more than the total number of the symbol stop positions of each of the, reel images. The discrete numerator is set so that the total number of the numerators of all of the selection probabilities for each of the reel images is equal to the common denominator. The modification of symbol selection table is performed, for example, by subtracting 1 from each of the denominator and numerator included in the selection probability associated with the selected symbol. In the case of selecting the symbol of "A", the symbol selection table is modified as shown in FIG. 14.

The processor 102*a* generates a random number and determines a symbol at the second symbol stop position (PN=2) based on the modified symbol selection table in FIG. 14 (S5). The symbol of "J" is selected as a symbol at the second symbol stop position in this example. The processor 102*a* repeats the procedures S3 to S5 for all of the remaining symbol stop positions (PN=3 to 10) (S6). For example, when the symbol of "J" is selected for the second symbol stop position, the symbol selection table is modified by changing the value of selection probability together with the range of random number value for each of the symbol candidates as shown in FIG. 15. Thereafter, when the symbol of "10" is selected for the third symbol stop position, the symbol selection table is modified as shown in FIG. 16. After determining the symbol arrangement of the first reel image, the processor-102*a* also repeats the procedures S2 to S6 for determining all of the remaining reel images (RN=2 to 5) (S7, S8). According to the symbol determination process in this embodiment, the symbol arrangements of the reel images can be changed with respect to each game under the condition in which all kinds of the symbol candidates are necessarily included in each of the reel images for each game.

In yet another embodiment of the present invention, the arrangement of symbols for each of the reel images may be determined by shuffling the symbol candidates. For example, the arrangement of symbols may be determined by selecting symbols from the discrete symbol candidates based on the selection probabilities so as to form a combination of symbols to be set on all of the symbol stop positions for each of the reel images and arranging the selected symbols in random order. According to this embodiment, all kinds of the symbol candidates can be included in each of the reel images for each game.

Figure 17:
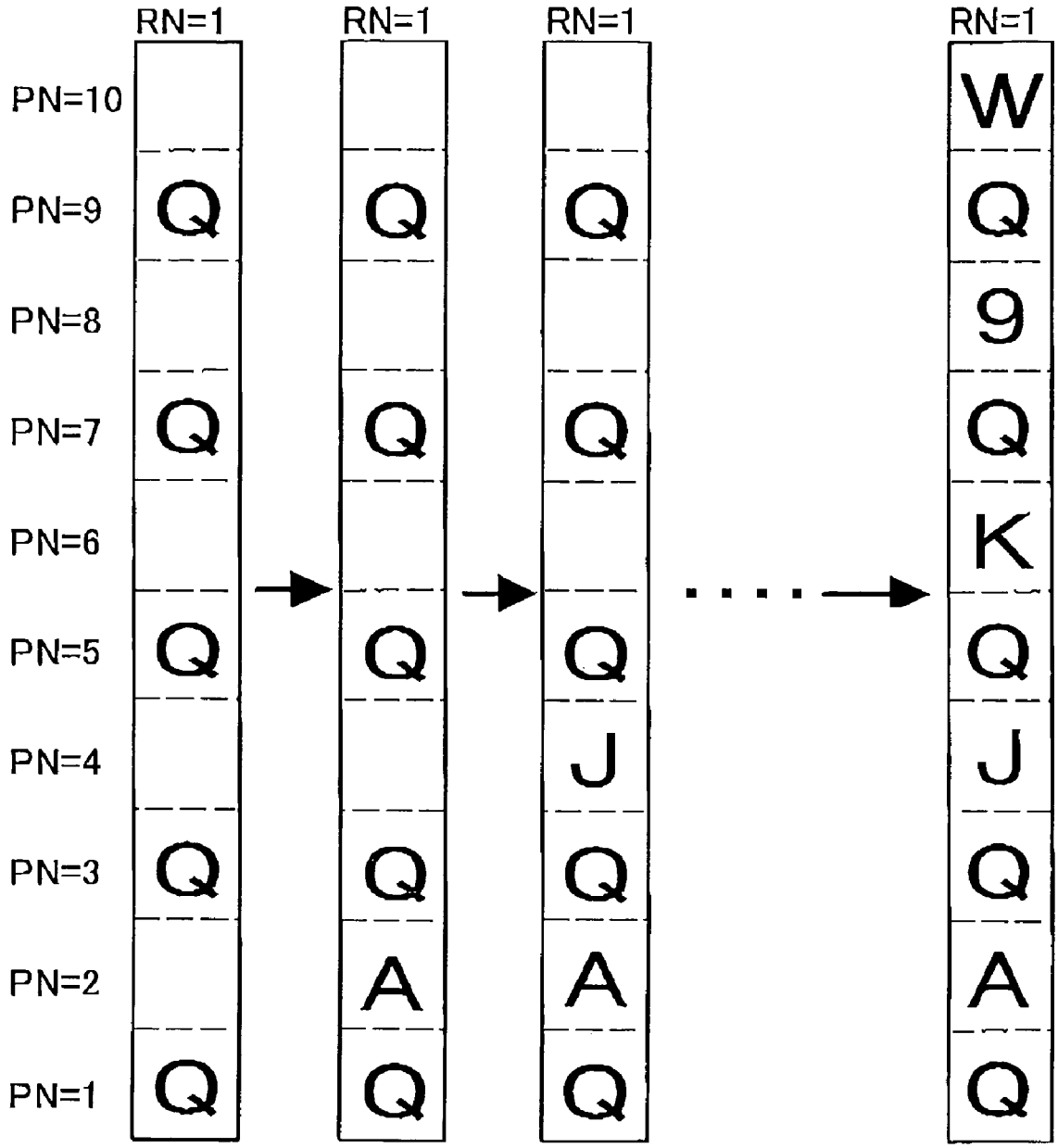
FIG. 17 is an explanatory view illustrating another example of a reel image.
Figure 18:
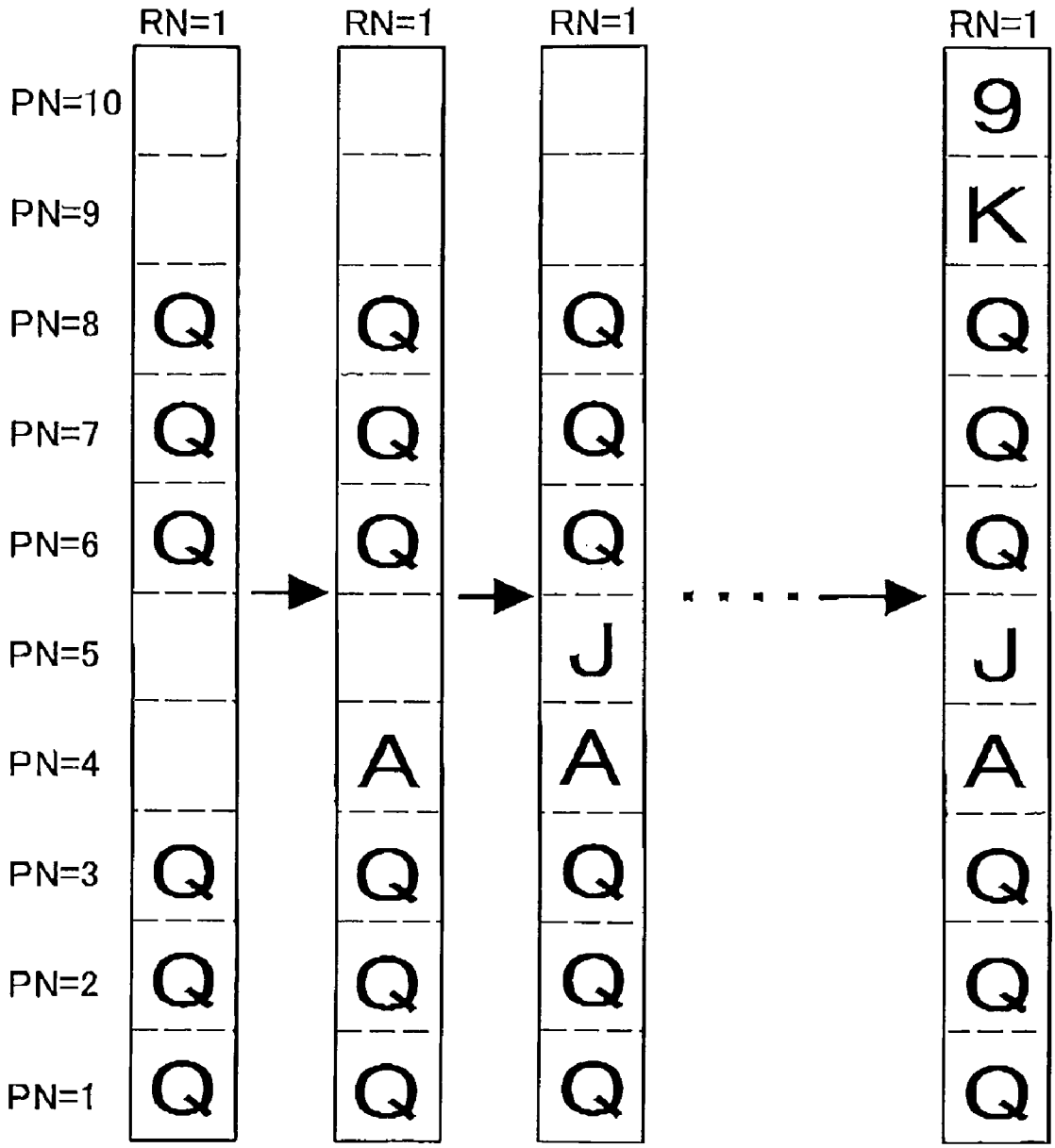
FIG. 18 is an explanatory view illustrating yet another example of a reel image.

In yet another embodiment of the present invention, a set of the symbol stop positions may be predetermined as reserved positions on which a common symbol is set in one symbol selection procedure. For example, the symbol stop positions (PN=1, 3, 5, 7, 9) alternately located on the first reel image (RN=1) may be predetermined as the reserved symbol stop positions and the symbol of "Q" may be set on the reserved positions as shown FIG. 17. In another example, two sets of three sequential symbol sop positions (PN=1-3, 6-8) on the first reel image (RN=1) may be predetermined as the reserved symbol stop positions and the symbol of "Q" may be set on the reserved positions as shown FIG. 18.

In yet another embodiment of the present invention, each of the reel images may be configured with an inner reel image and an outer reel image superimposed on the inner reel image. The outer reel image is defined to have at least one non-transparent area on which a corresponding area of the inner reel image is not visible and at least one transparent area on which a corresponding area of the inner reel image is visible. In this embodiment, the non-transparent area may be defined at adjacent symbol stop positions and a same symbol may be select to be set on each of the adjacent symbol stop positions. Furthermore, the symbols to be set on the symbol stop positions of the inner reel image and the outer reel image may be selected from different sets of the discrete symbol candidates respectively.

Figure 19:
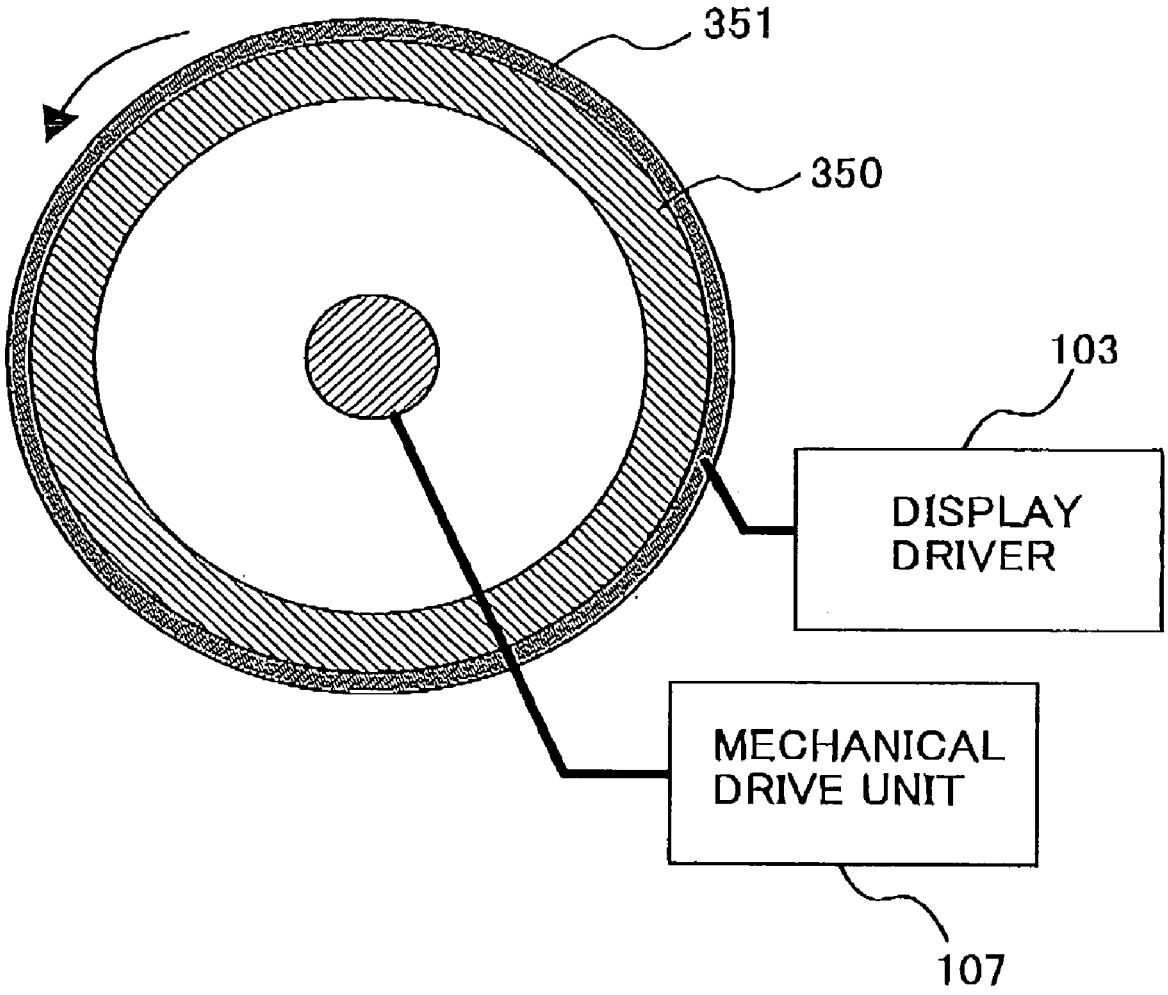
FIG. 19 is a cross-sectional view of a mechanical reel member with a display according to yet another embodiment of the present invention.

In yet another embodiment of the present invention, a gaming apparatus may be configured to have a plurality of mechanical reel members 305 installed in a cabinet 1 in stead of the reel display portion 300 of the display window 3B as shown FIG. 19. The mechanical reel member 305 is driven by a mechanical drive unit 107 installed in a cabinet 1. The mechanical drive unit 107 is coupled to the processor 102*a* of the controller 102. A cylindrical screen display 351 is attached on each of the circumferential surfaces of the mechanical reel members 350. The processor 102*a* controls the discrete cylindrical screen displays 351 via the display driver 103 to display the reel images respectively and to successively spin and then stop each of the mechanical reel members 350 in response to operation of a player. The arrangement of symbols for each of the reel images is determined by the processor 102*a* based on selection probabilities associated with the discrete symbol candidates as described in the aforementioned embodiments. Each of the discrete cylindrical screen displays 351 may be configured with an electronic paper or a liquid crystal sheet.

What is claimed is:

1. A gaming apparatus, comprising:

a display configured to display a plurality of rotatable reel images on corresponding display areas, wherein each of the rotatable reel images has more than three symbol positions; and a processor operatively coupled to the display, the processor being operable to:

determine an arrangement of symbols on all of the symbol positions for each of the rotatable reel images by selecting symbols to be set on all of the symbol positions of each rotatable reel image from discrete symbol candidates based on selection probabilities associated with the discrete symbol candidates respectively;

perform a lottery process by generating at least one random number for stopping movement of the rotatable reel images so as to display a part of the predetermined arrangement of symbols on each corresponding display area; and control the display to display each of the rotatable reel images on the corresponding display area based on the determined arrangement of symbols so that the symbols on all of the symbol positions of each rotatable reel image are successively moved in accordance with the predetermined arrangement of symbols and then stopped on the corresponding display areas so as to display the part of the predetermined arrangement of symbols based on a result of the lottery process in response to operation of a player.

2. The gaming apparatus according to claim 1, wherein the processor is operable to determine the arrangement of symbols for each of the reel images so as to select each symbol from the discrete symbol candidates in a manner to allow a redundant symbol selection from the discrete symbol candidates for each of the reel images.

3. The gaming apparatus according to claim 2, wherein the processor is operable to select a symbol to be set on each of the symbol positions forming the reel image from a common set of the discrete symbol candidates when determining the arrangement of symbols for each of the reel images.

4. The gaming apparatus according to claim 2, wherein at least one of the reel images includes at least one set of adjacent symbol positions on which a same symbol is set to be displayed, and wherein the processor is operable to determine the same symbol set on the adjacent symbol positions by selecting the same symbol from the discrete symbol candidates.

5. The gaming apparatus according to claim 1, wherein each of the selection probabilities associated with the discrete symbol candidates for each of the reel images is defined as a fractional expression with a common denominator and a discrete numerator, the common denominator being equal to or more than the total number of the symbol positions of each of the reel images, and the discrete numerator being set so that the total number of the numerators of all of the selection probabilities for each of the reel images is equal to the common denominator, and wherein the processor is operable to select symbols to be set on the symbol positions for each of the reel images by repeating:

selecting a symbol set on the symbol position from the discrete symbol candidates; and subtracting 1 from each of the denominator and numerator included in the selection probability associated with the selected symbol.

6. The gaming apparatus according to claim 1, wherein the processor is operable to determine the arrangement of symbols for each of the reel images by:

selecting symbols from the discrete symbol candidates based on the selection probabilities so as to form a combination of symbols to be set on all of the symbol positions for each of the reel images; and arranging the selected symbols in random order.

7. The gaming apparatus according to claim 1, further comprising a storage unit configured to be coupled to the processor and to store at least one set of the discrete symbol candidates with the predetermined selection probabilities, wherein the processor is operable to determine the arrangement of symbols by selecting symbols from the discrete symbol candidate stored in the storage unit.

8. The gaming apparatus according to claim 1, further comprising a data communication unit configured to be coupled to the processor and to communicate with an external apparatus to receive a set of the discrete symbol candidates with the predetermined selection probabilities, wherein the processor is operable to determine the arrangement of symbols by selecting symbols from the discrete symbol candidates received by the communication unit.

9. The gaming apparatus according to claim 1, wherein the number of the discrete symbol candidates is equal to or smaller than the number of the symbol positions of each of the reel images.

10. The gaming apparatus according to claim 1, wherein the number of the discrete symbol candidates is larger than the number of the symbol positions of each of the reel images.

11. The gaming apparatus according to claim 1, wherein the processor is operable to determine the arrangement of symbols for each of the reel images in response to an operation for starting each of games.

12. The gaming apparatus according to claim 1, wherein the processor is operable to determine the arrangement of symbols for each of the reel images used for a next game in response to a operation of terminating each of games.

13. The gaming apparatus according to claim 1, wherein the display is configured with a planate screen display or a curved screen display, which is attached on a housing, and wherein the processor is operable to control the display to display the reel images side by side based on the determined arrangement of symbols so that each of the reel images is successively moved and then stopped on the display in response to operation of a player.

14. The gaming apparatus according to claim 1, further comprising:

a plurality of mechanical reel members installed in a housing; and a mechanical drive unit configured to rotate the mechanical reel members, mechanical drive unit being coupled to the processor, wherein the display is configured with discrete cylindrical screen displays attached on the circumferential surfaces of the mechanical reel members, and wherein the processor is operable to control the discrete cylindrical screen displays to display the reel images respectively, and to successively spin and then stop each of the mechanical reel members in response to operation of a player.

15. The gaming apparatus according to claim 14, wherein each of the discrete cylindrical screen displays is configured with an electronic paper or a liquid crystal sheet.

16. The gaming apparatus according to claim 1, wherein each of the reel images is configured with an inner reel image and an outer reel image superimposed on the inner reel image, and wherein the outer reel image is defined to have at least one non-transparent area on which a corresponding area of the inner reel image is not visible and at least one transparent area on which a corresponding area of the inner reel image is visible.

17. The gaming apparatus according to claim 16, wherein the non-transparent area is defined at adjacent symbol positions, and wherein the processor is operable to select a same symbol to be set on each of the adjacent symbol positions.

18. The gaming apparatus according to claim 17, wherein the processor is operable to select symbols to be set on the symbol positions of the inner reel image and the outer reel image from different sets of the discrete symbol candidates respectively.

19. A method of operating a gaming apparatus with a display, comprising:

determining an arrangement of symbols on all of symbol positions for each of a plurality of rotatable reel images to be displayed on corresponding display areas of the display by selecting symbols to be set on all of the symbol positions of each rotatable reel image from discrete symbol candidates based on selection probabilities associated with the discrete symbol candidates respectively, wherein each of the rotatable reel images has more than three symbol positions;

performing a lottery process by generating at least one random number for stopping movement of the rotatable reel images so as to display a part of the predetermined arrangement of symbols on each corresponding display area; and displaying each of the rotatable reel images on the display based on the determined arrangement of symbols so that the symbols on all of the symbol positions of each rotatable reel image are successively moved in accordance with the predetermined arrangement of symbols and then stopped on the corresponding display areas so as to display the part of the predetermined arrangement of symbols based on a result of the lottery process in response to operation of a player.

20. A gaming apparatus, comprising:

a display configured to display a plurality of reel images; and a processor operatively coupled to the display, the processor being operable to:

determine an arrangement of symbols for each of the reel images before starting each of games, by selecting symbols to be set on symbol stop positions of the reel image from discrete symbol candidates based on selection probabilities associated with the discrete symbol candidates respectively; and control the display to display the reel images based on the determined arrangement of symbols in response to operation of a player, wherein each of the selection probabilities associated with the discrete symbol candidates for each of the reel images is defined as a fractional expression with a common denominator and a discrete numerator, the common denominator being equal to or more than the total number of the symbol stop positions of each of the reel images, and the discrete numerator being set so that the total number of the numerators of all of the selection probabilities for each of the reel images is equal to the common denominator, and wherein the processor is further operable to select symbols to be set on the symbol positions for each of the reel images by repeating:

selecting a symbol set on the symbol stop position from the discrete symbol candidates; and subtracting 1 from each of the denominator and numerator included in the selection probability associated with the selected symbol.

* * * * *